US006298607B1

(12) United States Patent
Mostaghel et al.

(10) Patent No.: US 6,298,607 B1
(45) Date of Patent: Oct. 9, 2001

(54) VENTING-MEMBRANE SYSTEM TO MITIGATE BLAST EFFECTS

(75) Inventors: Naser Mostaghel; Jiwan D. Gupta, both of Toledo, OH (US)

(73) Assignee: The University of Toledo, Toledo, OH (US)

( * ) Notice: Subject to any disclaimer, the term of this patent is extended or adjusted under 35 U.S.C. 154(b) by 0 days.

(21) Appl. No.: 09/281,327

(22) Filed: Mar. 30, 1999

Related U.S. Application Data

(60) Provisional application No. 60/081,992, filed on Apr. 16, 1998.

(51) Int. Cl.[7] ..... E04H 9/04

(52) U.S. Cl. ..... 52/1; 52/2.11; 52/2.23; 109/26; 109/49.5; 109/78

(58) Field of Search ..... 52/1, 2.11, 2.22, 52/2.23; 109/27, 81, 78, 49.5, 26

(56) References Cited

U.S. PATENT DOCUMENTS

| | | | | |
|---|---|---|---|---|
| 3,872,804 | * | 3/1975 | Yarnall | 109/49.5 |
| 3,974,313 | | 8/1976 | Jamies . | |
| 3,998,016 | | 12/1976 | Ting . | |
| 4,027,436 | | 6/1977 | Daly . | |
| 4,308,695 | | 1/1982 | Ehrsam . | |
| 4,414,777 | | 11/1983 | Masacchia . | |
| 4,432,285 | | 2/1984 | Boyars et al. . | |
| 4,433,522 | | 2/1984 | Yerushalmi . | |
| 4,662,289 | | 5/1987 | Harder . | |
| 4,718,356 | | 1/1988 | Caspe . | |
| 4,727,789 | * | 3/1988 | Katsanis et al. | 86/50 |
| 4,928,468 | | 5/1990 | Phillips . | |
| 5,173,374 | | 12/1992 | Tiedemann et al. . | |
| 5,206,451 | | 4/1993 | Bocker . | |
| 5,364,679 | * | 11/1994 | Groves | 428/76 |

* cited by examiner

*Primary Examiner*—Carl D. Friedman
*Assistant Examiner*—Yvonne M. Horton
(74) *Attorney, Agent, or Firm*—MacMilllan, Sobanski & Todd, LLC

(57) ABSTRACT

A venting-membrane system for mitigating blast pressure generated from a blast force on a wall structure. The venting-membrane system having a framework including a plurality of parallel structural members defining a wall structure having an interior surface and an exterior surface. At least one inflatable enclosure attached to the interior surface of the wall; and at least one inflatable enclosure attached to the exterior surface of the wall wherein the at least one inflatable enclosure attached to the interior surface of the wall is in communication with the at least one inflatable enclosure attached to the exterior surface of the wall.

5 Claims, 8 Drawing Sheets

VENTING-MEMBRANE SYSTEM TO MITIGATE BLAST EFFECTS

This appln. claims benefit of Prov. No. 60/081,992 filed Apr. 16, 1998.

FIELD OF THE INVENTION

This invention relates to a venting-membrane system to mitigate blast effects. More particularly, this invention relates to a venting-membrane system for mitigating blast pressure generated from a blast force on a wall structure.

BACKGROUND OF THE INVENTION

The car bombings of the World Trade Center in New York City in February 1993 and the Alfred P. Murrah Federal Building in Oklahoma City in April 1995 are perhaps the two most devastating terrorist acts in the United States. However, there are many less publicized criminal bombings. According to the Wall Street Journal (Aug. 2, 1996), there were 1,573 bombings and bomb attempts in the U.S. in 1990. Over the years this number has steadily grown to 2,438 in 1994, the last full year for which statistics are available. This is an increase of over 10% per year. It is clear that effective techniques have to be devised to improve the security of buildings against the effects of criminal bomb blasts.

The current techniques to enhance building security are: 1) detection and prevention, 2) keep-out distance and 3) structural modifications to increase ductility, redundancy, and load path.

The economic and social costs of detection and prevention on a routine basis include intrusions on individual privacy and curtailment of people's movements, which is not possible in an open society.

For a given charge weight (equivalent amount of TNT), the larger the keep-out distance, the less would be the blast load on the structure. However, many public and private buildings are located in metropolitan areas where the cost of real estate is high, and most often the keep-out distance is limited to the public sidewalk.

Structural modifications to increase ductility, redundancy and load path invariably involve structural stiffening. Stiffening the structure reduces its fundamental natural period. Reducing in the fundamental period of a structure would increase the level of the blast load that the structure can experience.

Another technology that could possibly be used to mitigate some of the blast effects is to increase the fundamental natural period of the structure via seismic base isolation technology. However, due to the variety of structural components and their response modes, and the uncertainty of the frequency and magnitude of the blast loads, it is not clear how effective seismic isolation would be. This is an area that merits further investigation. Of course there are other means of changing the natural period of structures and structural elements.

Here an alternative technology is proposed which does not have any of the limitations of the current techniques enumerated above. The proposed technology involves covering each face of an exposed wall with a very flexible and inflatable double layer membrane. When inflated, the flexible membranes are vented to each other through holes in the wall. There are also pliable cover walls which protect the membranes against explosion-generated projectiles. A structure utilizing the proposed technology 1) attracts a much smaller fraction of the blast load due to its large flexibility; 2) by venting the blast pressure from the front of a structural element, such as a panel, to its back, reduces the load which are to be resisted by the structural element and the structure as a whole; 3) can protect people and equipment from flying projectiles generated by spalling of the surfaces of the walls.

The proposed technology does not have any of the limitations of the current techniques. It can be used to mitigate blast effects on external walls as well as internal walls such as the ones in the underground parking lots. It can also be used for new as well as existing structures.

SUMMARY OF THE INVENTION

Briefly, the present is directed to a venting-membrane system for mitigating blast pressure generated from a blast force on a wall structure. The venting-membrane system having a framework including a plurality of parallel structural members defining a wall structure having an interior surface and an exterior surface. At least one inflatable enclosure attached to the interior surface of the wall; and at least one inflatable enclosure attached to the exterior surface of the wall wherein the at least one inflatable enclosure attached to the interior surface of the wall is in communication with the at least one inflatable enclosure attached to the exterior surface of the wall.

BRIEF DESCRIPTION OF THE DRAWINGS

Further features and other objects and advantages of this invention will become clear from the following detailed description made with reference to the drawings in which:

FIG. 3(*b*) is a curve showing variation of the load P(t) with time;

FIG. 3(*c*) is a spring-mass model representing the venting-membrane system of FIG. 2;

DETAILED DESCRIPTION OF THE PREFERRED EMBODIMENTS

Figure 1:
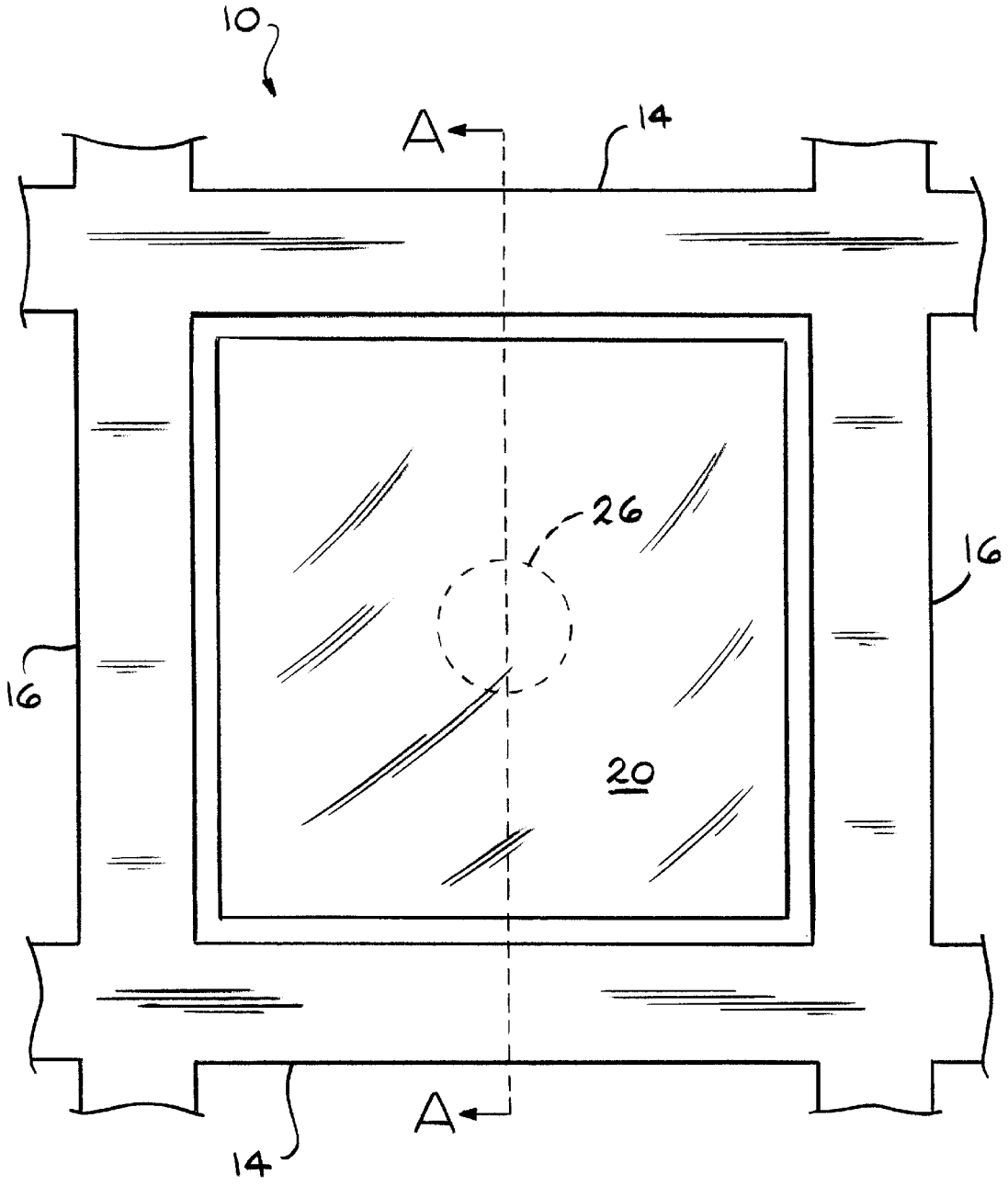
FIG. 1 is a front view of the venting-membrane system of the invention.

Referring to the drawings, wherein like reference characters represent like elements, FIGS. 1–6 pertain to a venting membrane system 10 in accordance with the present invention to mitigate blast effects, e.g., on a wall structure 12. It will be appreciated that the wall structure 12 may be constructed using methods and materials well known in the art in accordance with the present invention as further described herein.

Figure 2:
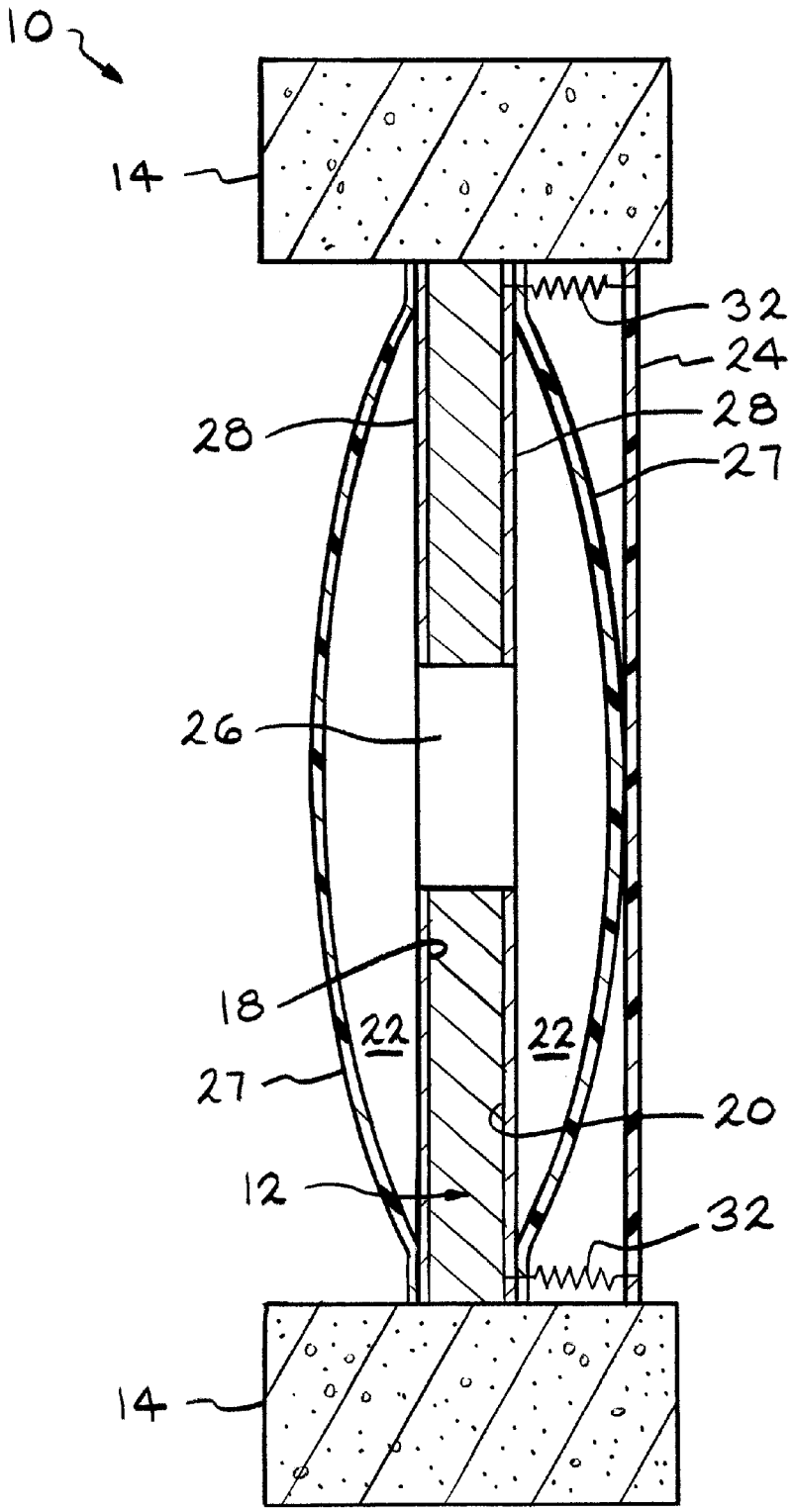
FIG. 2 is a cross-sectional view of the system of FIG. 1 taken along line A—A.
Figure 4:
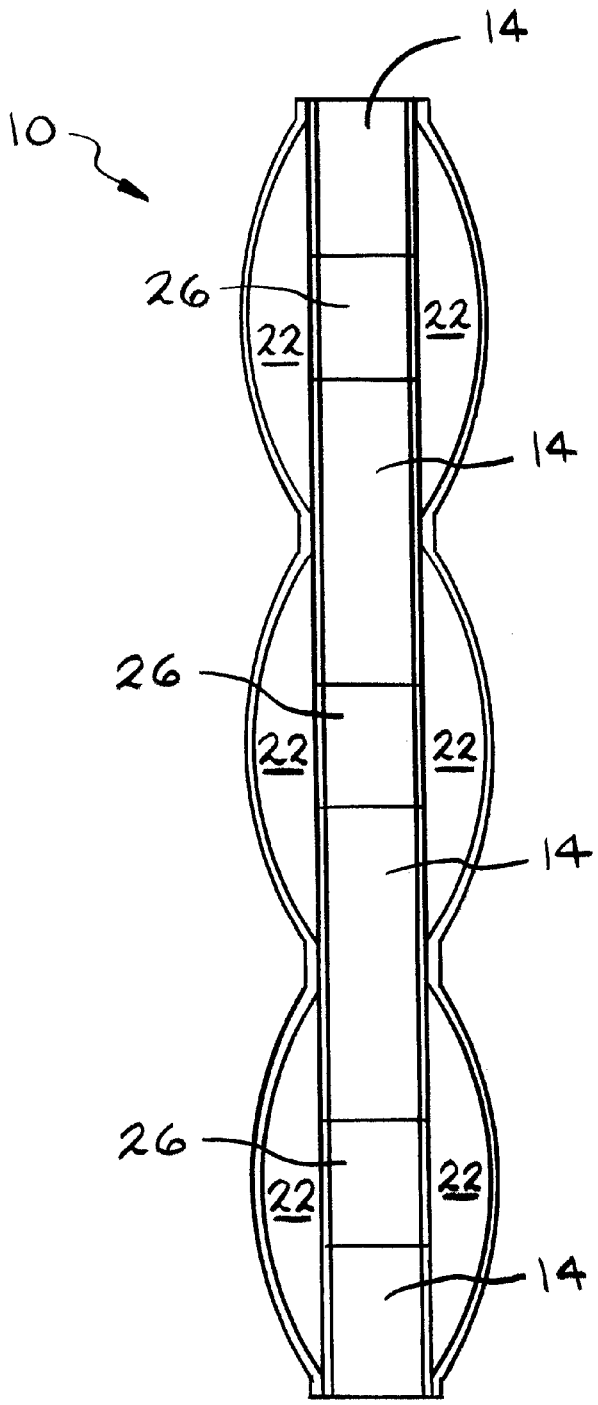
FIG. 4 is a cross sectional view of the venting-membrane system according to another embodiment of the invention viewed along line A—A of FIG. 5.
Figure 5:
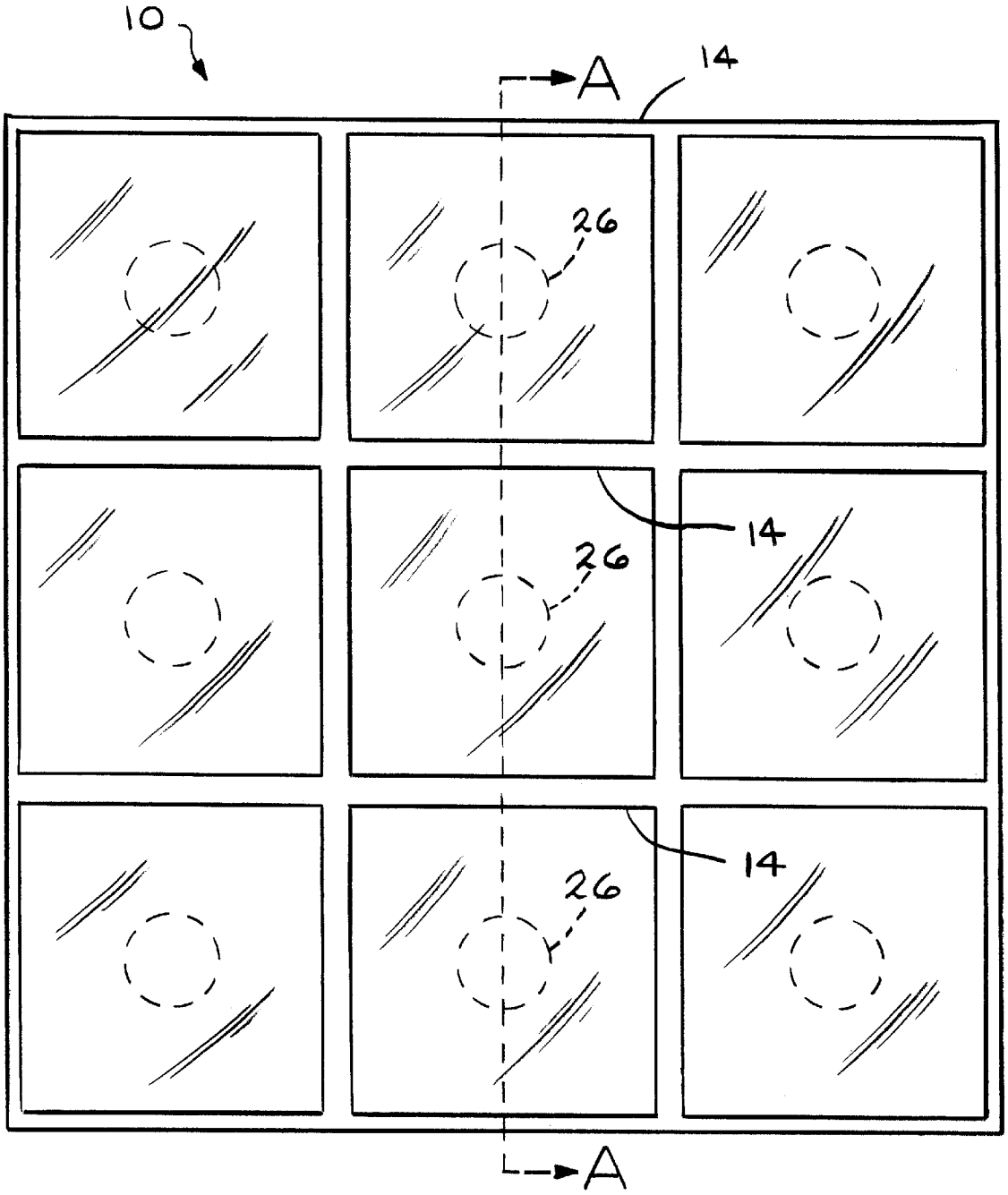
FIG. 5 is a front view of the venting-membrane system of FIG. 4.

As shown in FIGS. 1 and 4, the wall structure 12 is formed of a plurality of parallel supporting structural members, such as beams 14 and columns 16, having an interior surface 18 and an exterior surface 20. Referring to FIGS. 2 and 4, at least one inflatable enclosure 22 is attached to the interior surface 18 of the wall and at least one inflatable enclosure is attached to the exterior surface 20 of the wall.

The at least one inflatable enclosure 22 attached to the interior surface 18 of the wall is in communication with the at least one inflatable enclosure attached to the exterior surface 20 of the wall. In a preferred embodiment, the inflatable enclosures 22 are vented to each other via one or more holes 26 through the wall structure 12.

As shown in FIGS. 1 and 2, the inflatable enclosure 22 preferably includes a facing membrane 27 spaced apart from a cover membrane 28. The facing membrane 27 and the cover membrane 28 define the inflatable enclosure 22 therebetween. The inflatable enclosure 22 illustrated is an air filled membrane pocket. It should be understood that the facing membrane 27 and the cover membrane 28 may be integrated into one structure or be two separate structures. The cover membrane 28 is preferably fixed to the exterior surface 20 and the interior surface 18 of the wall 12. The cover membrane 28 is preferably connected to the facing membrane 27 proximate to the nearest beam 14 to which the facing membrane 27 is adjacent. One or more springs 32 may be provided to operatively connect the pliable wall 24 proximate the inflatable enclosure 22. The spring 32 is preferably fixed to the facing membrane 27 and the pliable wall 24 proximate to the nearest beam 14. The beams 14 and the columns 16 form the wall structure 12. The wall structure 12 illustrated includes the wall. The cover membrane 28 preferably does not obstruct the vent hole 26 in the wall.

The inflatable enclosures 22 are formed of a membrane material that is impermeable or semi-permeable to air or suitable gas. For example, the membrane material may be formed of EPDM and the like.

To protect the membrane material of the venting-membrane system 10 from a direct blast load or projectiles, the venting membrane system may include a pliable cover wall 24. The function of the pliable wall 24 is to protect the facing membrane 27 from the projectiles that are generated during explosion. The pliable wall 24 may be formed of most any durable material and preferably elastically supported from the wall structure 12 using most any suitable method known in the art. The pliable wall may also be an insulative cover material or a woven protective material. e.g., Kevlar® fibers, of a type well known in the art.

When the blast pressure reaches the wall structure 12, the pliable cover wall 24 transfers the pressure to the facing membrane 27. The facing membrane 27 under this pressure flattens, and as it deforms it vents the air into the other side of the wall, thereby increasing the pressure behind the wall. This increased pressure behind the wall helps to stabilize the wall, essentially using the blast pressure against itself The facing membranes 27 also serve to contain any spallings from the wall surfaces. The duration of blast loading is quite short. Therefore, the geometry and the properties of the wall and the membranes as well as the characteristics of the blast and its distance from the structure are believed important parameters in the operation of the venting-membrane system 10.

The venting-membrane system is believed to provide an economical and efficient method to protect new and existing structures against accidental as well as intentional blast loadings. An analysis of the effectiveness of the venting-membrane system is given below.

In general two types of shock loads are generated by an explosion, air shock load and ground shock load. Here it is assumed that the explosion is going to take place close to the structure. Therefore, the air-blast shock front propagates through the highly compressed air at very high speeds. As such only the air shock load is considered here. In general air blast imparts horizontal, vertical, and overturning motions to structures in its path. Both vertical and overturning motions are assumed to be small and are not considered here. It is assumed that there exists enough friction at the foundation level to prevent any sliding motion of the structure as a whole.

The forces imparted to an above ground structure by any given set of free-field incident and dynamic pressure pulses can be classified into four general components: (a) the force resulting from the incident pressure, (b) the force associated with the dynamic pressures, (c) the force resulting from the reflection of the incident pressure impinging upon an interfering surface, and (d) the pressures associated with the negative phase of the shock wave As an example we consider the reflected pressure because it is the largest pressure generated by the blast. The duration of this pressure loading is very short. For example, according to the procedure presented in reference, it can be shown that the maximum reflected impulse and the maximum reflected pressure due to the positive phase of an air shock associated with the detonation of a 600 pound hemispherical TNT charge located on the ground surface at a distance of 36 feet from a structure (assuming zero angle of incident) are $I=403^{psi\text{-}ms}$ and $P=308^{psi}$ respectively. The effective duration of the positive phase of this air shock, $t_o$, based on an equivalent triangular pulse, is of the order of $t_0=2.6$ mili-seconds.

Figure 3A:
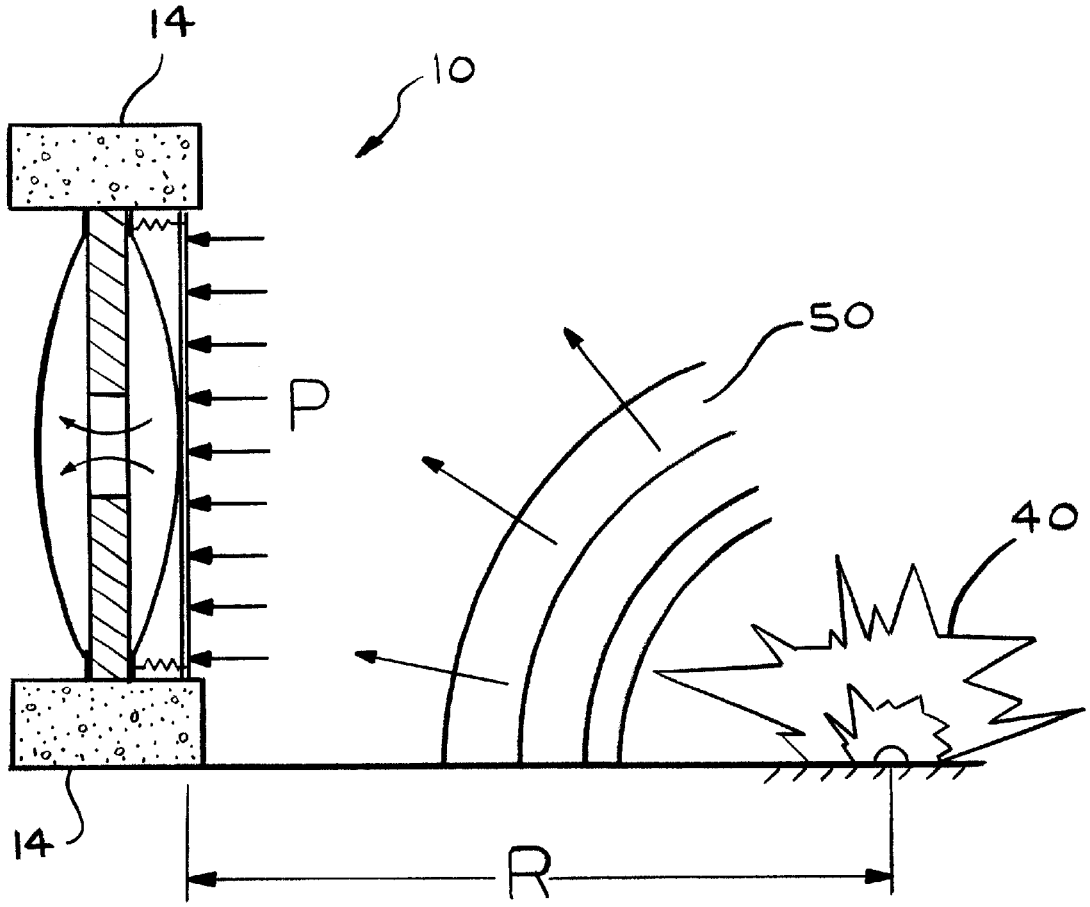
FIG. 3(*a*) is a schematic representation of the effect from a blast on the wall of FIG. 1.
Figure 3B:
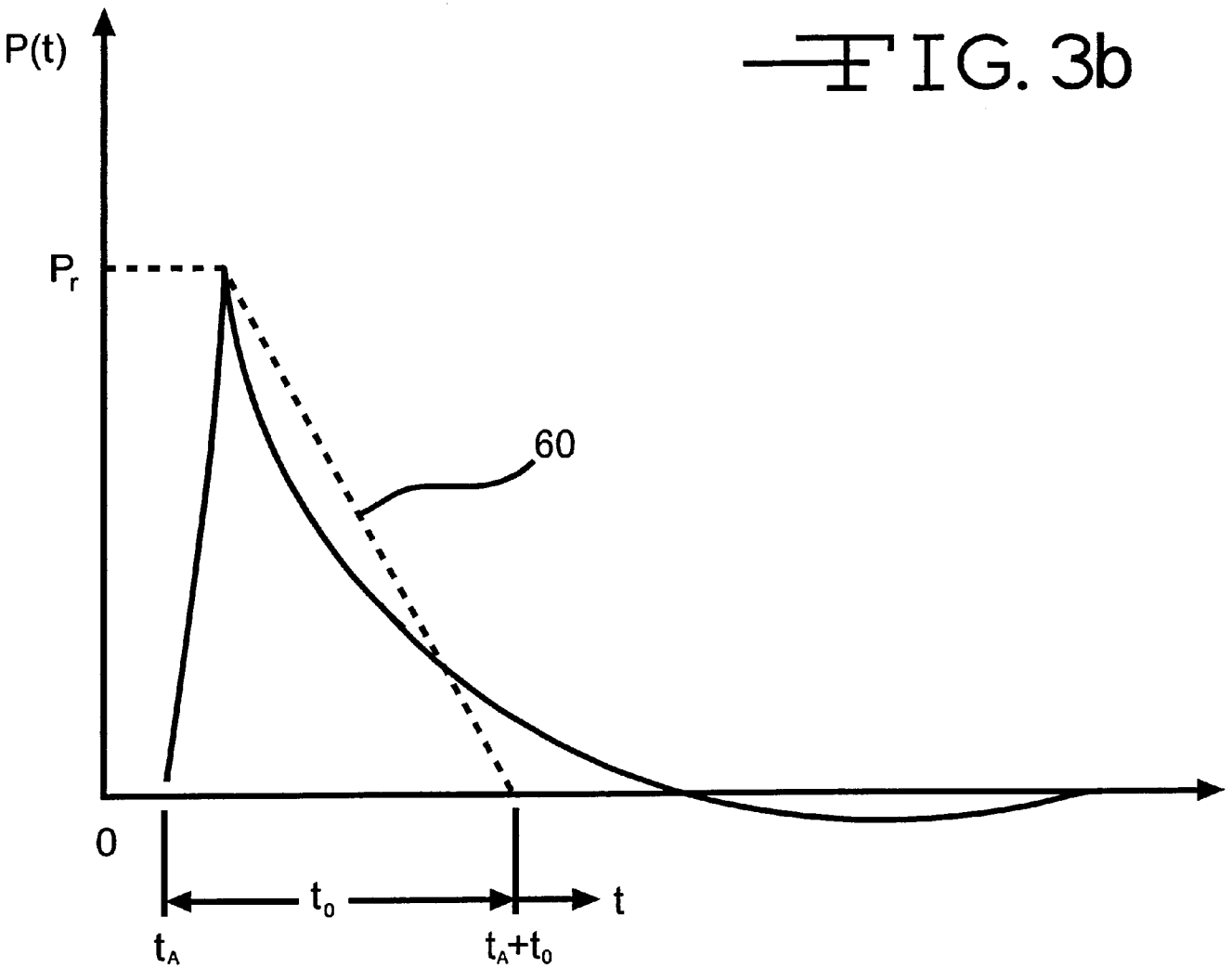
Figure 3C:
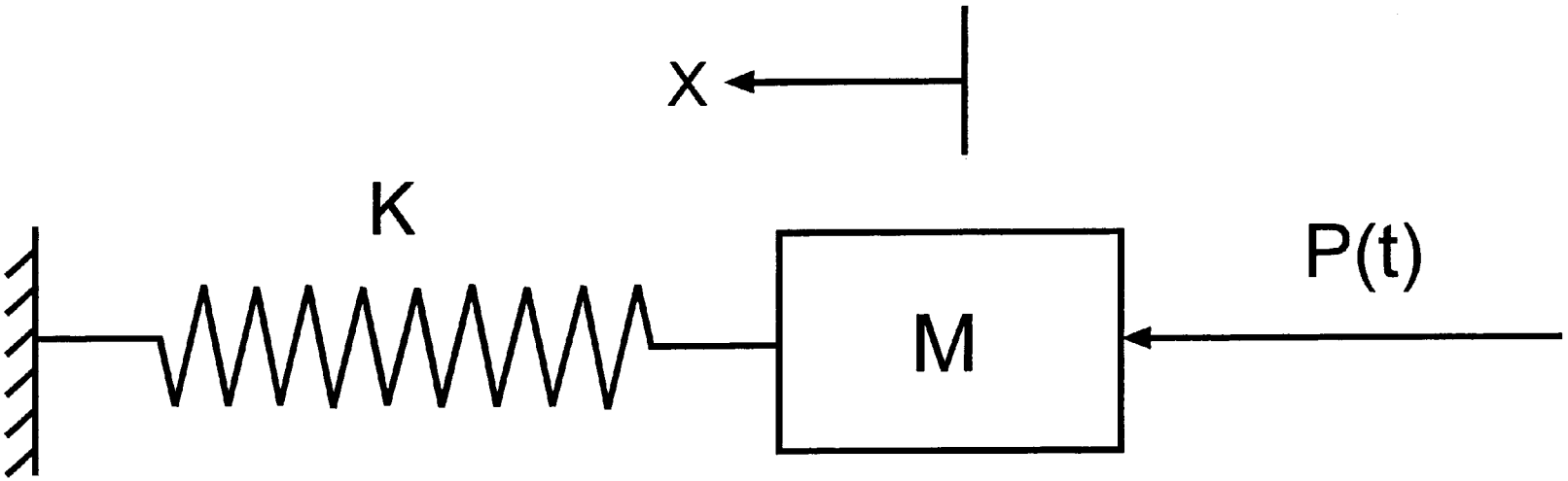

The pliable cover wall 24 together with its spring support and the membranes and the enclosed air constitute the venting membrane system 10. Representing the total mass of the venting-membrane system by M and its total stiffness in the direction perpendicular to the wall by K, then the venting-membrane system can be represented by the spring-mass model shown in FIG. 3(*c*). The variation of the load P(t) with the time is shown in FIG. 3(*b*). As shown in FIG. 3(*a*), it is assumed that the applied pressure distribution on the pliable cover wall is uniform. FIG. 3*a* shows a blast, indicated generally at 40, generating pressure waves, indicated generally at 50. The pressure waves 50 result in a pressure P contacting the venting-membrane system 10. The blast 40 is illustrated at about a distance R from the venting-membrane system 10. Considering only the positive phase of the blast load, and assuming a very short duration pulse, it can be shown that $$x(t) = \frac{I}{M\omega}\mathrm{Sin}\omega t, \tag{1}$$

where x(t) represents the displacement response, $\omega=\sqrt{K/M}$ denotes the circular natural frequency of the system, and $$I = \int_{d}^{d+l_u} P(t)\,dt \tag{2}$$

is the magnitude of the impulse. Therefore the maximum pressure, Qmax, felt by the pliable cover wall is given by $$Q_{\max} = Kx_{\max} = \omega I = 2\pi\frac{I}{T}, \tag{3}$$

where T is the fundamental natural period of vibration of the venting-membrane system. Representing the impulse I by an equivalent triangle 60 (FIG. 3(*b*)), the impulse can be represented by $$I = \frac{P_r t_0}{2}, \tag{4}$$

where Pr is the peak reflected pressure- Substitution for I from the above equation into equation (3) yields $$Q_{max} = c_p P_r, \tag{5}$$

where the pressure reduction coefficient cp (commonly defined as the maximum dynamic load factor) is given by $$c_p = \pi \frac{t_0}{T}. \tag{6}$$

The basic assumptions for the above equation are that the duration t0 is much smaller than the period T and that the system behavior remains linear. For a given blast duration, the above relation implies that a system with a larger natural period will be subjected to a lower amount of load. As an example, a natural period of T=2 seconds for a venting-membrane system fitted on a wall subjected to the 600 pound bombing event cited above would yield a pressure reduction factor of cp=(3.14)(2.6 ms/2 s)=0.004. Therefore, the maximum effective amplitude of the reflected pressure, applied to the wall, for the above case would be Qmax=(0.004)(308 psi)=1.26 psi=181 psf.

When the size of the wall is large the bulge in the facing membrane can become too large. In this case, a multi-venting-membrane system 10 (see FIG. 5) can be used.

In place of the spring (or along with it) to provide supports around the pliable cover wall, one can envision a circumferential membrane.

If other means of attaching the facing membranes 27 to the wall are utilized, then one does not have to use the cover membrane 28 shown in FIG. 1, section A—A, as long as the system can be inflated and will not leak.

Figure 6:
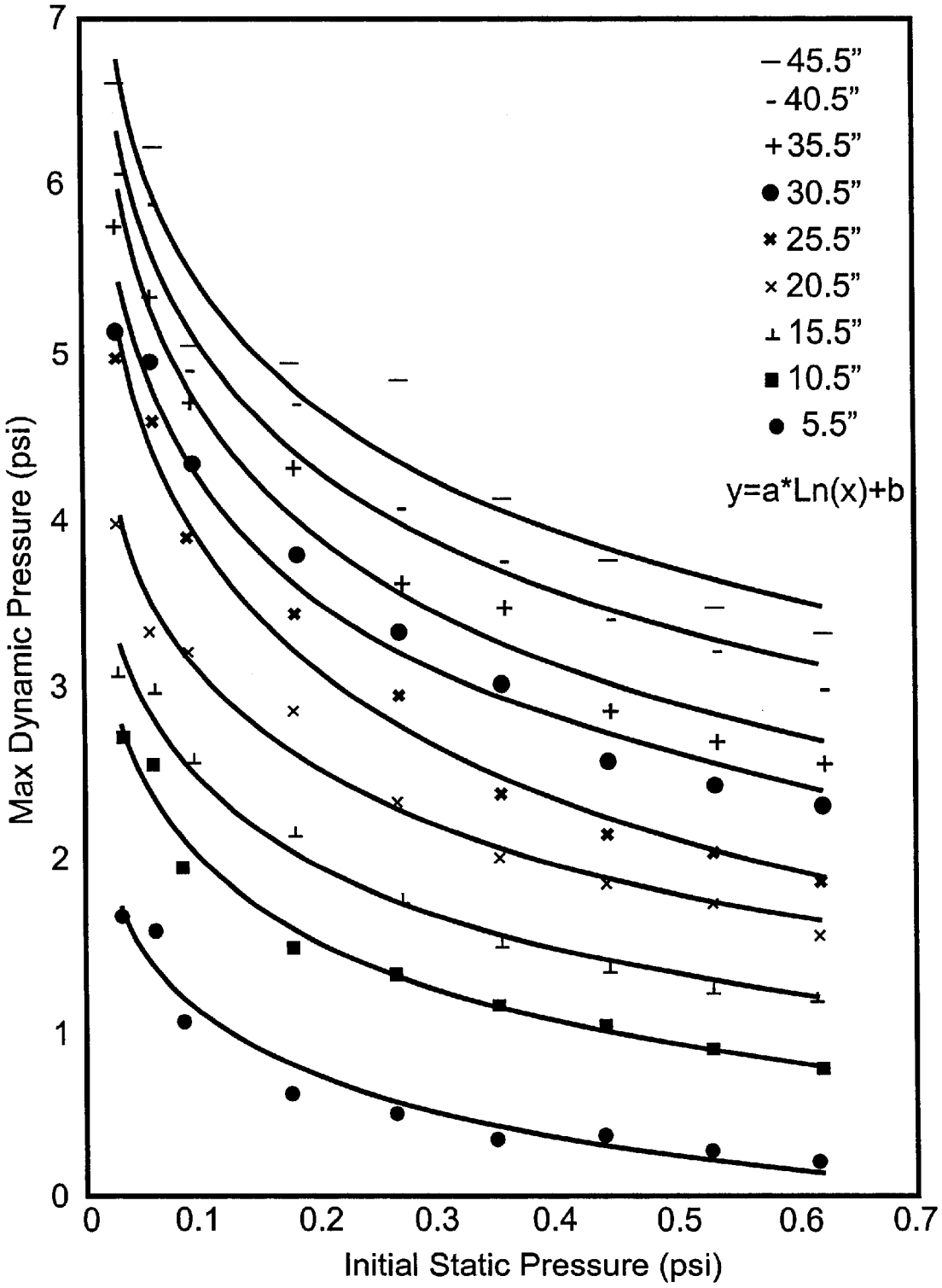
FIG. 6 is a chart of dynamic pressure and initial static pressure.

The invention will be further clarified by consideration of FIG. 6 and Table 1, which are intended to be purely exemplary of the use of the invention.

The results from a falling weight on a membrane in accordance with the present invention was observed and plotted as a chart. As shown in FIG. 6 and Table 1, the dynamic pressure increases as the initial static pressure under the membrane is reduced. Also, the smaller the initial static pressure, the larger the rate of increase of the dynamic pressure. As the initial static pressure goes to zero, the dynamic pressure becomes much larger. Zero initial static pressure is equivalent to having no membrane; however, to protect the strain and pressure gauges from the direct impact of the falling weight, tests, with zero initial static pressure were not carried out. Table 1 shows the results of a simulated blast mitigation effect of the venting-membrane system. The simulation approximates the pressure exerted on the structure described in the table by an explosion of 100 pounds of TNT at a distance of 100 feet from the structure described.

TABLE 1.

Simulated Blast Mitigation Effect of the Venting-Membrane System

| Structure Description | Pressure (p.s.i.) |
|---|---|
| Wall Structure without Venting-Membrane System | 6.2 |
| Wall Structure with Venting-Membrane System but no vent hole | 1.8 |
| Wall Structure with Venting-Membrane System and vent hole | 0.8 |

The vents formed within the wall structure may be of almost any suitable size and number to dissipate the energy from the blast upon the exterior inflatable membrane and through the movement of the gas through the vents and the expansion of the interior inflatable enclosure.

The following references are hereby incorporated by reference in their entirety:

Protecting Buildings from Bomb Damage, Committee on Feasibility of Applying Blast-Effects Mitigation Technologies and Design Methodologies from Military Facilities to Civilian Buildings, National Academy Press, Washington, D.C. 1995.

Blast Resistance Design of Commercial Buildings, Mohammed Ettouney, Robert Smilowitz. Tod Rittenhouse, Practice Periodical on Structural Design and Construction, Vol. 1, No I. February 1996.

Retrofit Protection of Buildings Against Terrorist Explosion, Paul Weidlinger. Proc. of the International Conference on Retrofitting of Structures, Columbia University, New York, pp. 282–310, Mar. 11–13, 1996.

Aseismic Base Isolation: Review and Bibliography, J. M. Kelly, Soil Dynamics and Earthquake Engineering, Vol. 5, No. 3, pp. 202–217, 1986.

Seismic Response of Structures Supported on R-FEBI System, N. Mostaghel. M. Khodaverdian, Journal of Earthquake Engineering and Structural Dynamics, Vol. 16, pp. 839–854,1988.

Device for Base Isolating Structures from Lateral and Rotational Support Motion, N. Mostaghel, U.S. Pat. No. 4,633,628 (Jan. 6, 1984).

Shifting Natural Frequencies of Plates Through Preforming, N. Mostaghel, K. C. Fu, Q. Yu, Journal of Earthquake Engineering and Structural Dynamics, Vol. 24, pp. 411–418, 1995.

Dynamics of Structures, Theory and Applications to Earthquake Engineering, Anil K. Chopra, Prentice Hall, 1995.

The patents and documents referenced herein are hereby incorporated by reference in their entirety.

Having described presently preferred embodiments of the invention, the invention may be otherwise embodied within the scope of the appended claims.

What is claimed is:

1. A venting-membrane system for mitigating blast pressure generated from a blast force on a wall structure, the venting-membrane system comprising:

a framework including a plurality of parallel structural members defining a wall structure having an interior surface and an exterior surface;

at least one inflatable enclosure attached to the interior surface of the wall structure; and at least one inflatable enclosure attached to the exterior surface of the wall structure wherein the least one inflatable enclosure attached to the interior surface of the wall structure is in communication with the at least one inflatable enclosure attached to the exterior surface of the wall structure.

2. The venting-membrane system of claim 1 wherein the at least one inflatable enclosure attached to the exterior surface of the wall structure is in communication with the at least one inflatable enclosure attached to the interior surface of the wall structure through at least one vent hole formed within the wall structure.

3. The venting-membrane system of claim 1 wherein the at least one inflatable enclosure comprises a cover membrane attached to the wall and a facing membrane juxtaposed from the cover membrane and secured to the cover membrane along the marginal edges thereof.

4. The venting-membrane system of claim 1 further comprising a pliable cover wall elastically supported from the at least one inflatable enclosure.

5. The venting-membrane system of claim 1 wherein the at least one inflatable enclosure comprises a cover membrane attached to the exterior surface of the wall structure and a cover membrane attached to the interior surface of the wall structure along the marginal edges thereof.

* * * * *